US010799019B2

(12) United States Patent
Wilson

(10) Patent No.: US 10,799,019 B2
(45) Date of Patent: Oct. 13, 2020

(54) MESSAGING AND ORNAMENTAL COFFEE TABLE SYSTEM AND METHOD OF OPERATION

(71) Applicant: Marilyn V Wilson, Indianapolis, IN (US)

(72) Inventor: Marilyn V Wilson, Indianapolis, IN (US)

(73) Assignee: Marilyn Virginia Wilson, Indianapolis, IN (US)

( * ) Notice: Subject to any disclaimer, the term of this patent is extended or adjusted under 35 U.S.C. 154(b) by 382 days.

(21) Appl. No.: 15/932,685

(22) Filed: Apr. 10, 2018

(65) Prior Publication Data

US 2019/0307244 A1 Oct. 10, 2019

(51) Int. Cl.

| | |
|---|---|
| ***A47B 13/12*** | (2006.01) |
| ***A47B 13/02*** | (2006.01) |
| ***A47B 13/16*** | (2006.01) |
| ***A47G 7/04*** | (2006.01) |
| ***G09F 13/00*** | (2006.01) |
| ***A47B 13/08*** | (2006.01) |
| ***A47B 25/00*** | (2006.01) |
| ***A47B 21/007*** | (2006.01) |

(52) U.S. Cl.

CPC ..... *A47B 13/12* (2013.01); *A47B 13/02* (2013.01); *A47B 13/16* (2013.01); *G09F 13/00* (2013.01); *A47B 13/081* (2013.01); *A47B 25/00* (2013.01); *A47B 2021/0076* (2013.01); *A47B 2220/0077* (2013.01); *A47G 7/041* (2013.01)

(58) Field of Classification Search

CPC ..... A47B 13/12; A47B 13/125; A47B 13/16; A47B 13/02; A47B 25/00; A47B 2021/0076; A47B 13/081; A47G 7/041; G09F 13/00

See application file for complete search history.

(56) References Cited

U.S. PATENT DOCUMENTS 1,259,970 A * 3/1918 Elliott ..... A47B 13/16 108/26
1,682,686 A * 8/1928 Rutherford ..... G09B 17/00 434/172

(Continued)

FOREIGN PATENT DOCUMENTS

EP 2074907 A1 * 7/2009 ..... A47B 25/00

*Primary Examiner* — Kevin R Kruer

(57) ABSTRACT

A messaging and ornamental coffee table system and method of operation provides a coffee table comprising a resilient base, sidewalls extending up from the resilient base and forming a cavity, and an at least partially transparent table top having a depressed message portion and hingedly connected to one of the sidewalls. The system further comprises at least one light source operational in the cavity to illuminate towards the at least partially transparent table top. The system further comprises a plurality of tiles defined by multiple faces displaying alphanumeric characters, or symbols, or both. The tiles are arrangable on the message portion to display a message. The system further comprises an at least partially transparent ornamental member disposed on the table top. The illumination from light source illuminates the alphanumeric characters and symbols of tiles, and the at least partially transparent ornamental member to enhance visibility and decorative effect thereof.

7 Claims, 3 Drawing Sheets

(56) References Cited

U.S. PATENT DOCUMENTS 1,978,107 A * 10/1934 Hoffmann ..... A63F 9/10 273/153 R
2,937,460 A * 5/1960 Everett ..... G09B 17/00 434/172
3,503,612 A * 3/1970 Singer ..... A63F 3/0423 273/272
4,341,389 A * 7/1982 Dumont ..... A63F 9/0098 273/239
4,765,253 A * 8/1988 Schappach ..... A47B 3/06 108/158.12
5,799,943 A * 9/1998 Morgan ..... A63F 3/0423 273/160
7,018,210 B2 * 3/2006 Goldman ..... G09B 1/36 434/172
2006/0000393 A1 * 1/2006 Ka'ahumanu ..... A47B 13/12 108/25
2006/0093996 A1 * 5/2006 Goldman ..... G09B 1/36 434/171
2007/0051282 A1 * 3/2007 Huang ..... A47B 13/12 108/27
2008/0006182 A1 * 1/2008 Mason ..... G09F 23/06 108/25
2008/0291659 A1 * 11/2008 Huang ..... A47B 13/12 362/84
2009/0050028 A1 * 2/2009 Liao Fang ..... A47B 13/12 108/26
2012/0020112 A1 * 1/2012 Fisher ..... F21V 33/0012 362/608
2012/0023707 A1 * 2/2012 Edwards ..... B62B 15/00 16/42 R
2013/0102842 A1 * 4/2013 Zwezdaryk ..... A47C 16/02 600/38
2018/0078849 A1 * 3/2018 Pybus ..... A63F 3/0423
2018/0222628 A1 * 8/2018 Akhavan-Tabassi .... B65D 9/24
2020/0054934 A1 * 2/2020 Takacs ..... G07F 17/322

* cited by examiner

MESSAGING AND ORNAMENTAL COFFEE TABLE SYSTEM AND METHOD OF OPERATION

FIELD OF THE INVENTION

The present invention relates generally to a messaging and ornamental coffee table system and method of operation. More so, the present invention relates to a coffee table system that provides a supportive table comprising a resilient base, a plurality of sidewalls extending up from the resilient base and forming a cavity, and an at least partially transparent table top defined by a depressed message portion and hingedly connected to one of the sidewalls, so as to regulate access to the cavity; whereby the coffee table system further comprises at least one light source operational in the cavity and illuminating through the at least partially transparent table top, and guided substantially towards the message portion of the table top; whereby the coffee table system further comprises a plurality of tiles defined by multiple faces displaying alphanumeric characters, or symbols, or both, and arrangable on the message portion to display a message; whereby the coffee table system further comprises an at least partially transparent ornamental member disposed on the table top, such that the illumination from the light source illuminates the alphanumeric characters and symbols of the tiles and the at least partially transparent ornamental member to enhance visibility and decorative effect thereof.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a table is an item of furniture with a flat top and one or more legs or multiple supportive panels, used as a surface for working at, eating from or on which to place things. One type of table used in living rooms of modern residences or waiting rooms of offices is a coffee table. The coffee table often includes a surface for food and drink, displaying decorative items, and storing other materials and items. Often decorative objects are positioned on top of the coffee tale to create conversation pieces.

Generally, illumination creates a glowing, reflective decorative effect on objects; and especially partially transparent objects. Typical light sources used indoors for decorative effect include: fluorescent LED strips, fluorescent light bulbs, incandescent light bulbs, neon lights, and candles. The intensity, color, and lighting pattern of such light sources can be adjusted to achieve a desired decorative effect.

Often, messages are transmitted between parties in a residence or office containing a coffee table. One known system of relaying messages includes tiles or blocks bearing a single letter, number, or symbol. The tiles can be rotated or manipulated in a number of ways to must form words which, read in rows or downwards in columns, can be defined in a standard dictionary or lexicon. Such a messaging means can be convenient and easy to alter for any number of users.

Other proposals have involved ornamentally configured tables and messaging systems. The problem with these tables and messaging systems gripping devices is that they do not efficiently combine decorative aspects with the functional aspects of relaying messages. Also, the message is not always clearly visible when there is limited lighting. Even though the above cited ornamentally configured tables and messaging systems meet some of the needs of the market, a hose gripping apparatus that wraps around a messaging and ornamental coffee table system and method of operation provides a coffee table that illuminates ornamental objects while allowing for illuminated messaging with tiles, so as to serve as a conversation piece, is still desired.

SUMMARY

Illustrative embodiments of the disclosure are generally directed to a messaging and ornamental coffee table system and method of operation. The coffee table system and method of operation provides a supportive table, which may include a coffee table. The table comprises a resilient base, a plurality of sidewalls extending up from the resilient base and forming a cavity, and an at least partially transparent table top. The table top is hingedly connected to one of the sidewalls, so as to regulate access to the cavity. The table top may be defined by a depressed message portion.

In some embodiments, the coffee table system further comprises at least one light source that is operational in the cavity of the table. The light source illuminates through the at least partially transparent table top, such that objects on the table top are affected by the illumination. The light source may include a fluorescent LED strip or a fluorescent light oriented to illuminate towards the table top. A guide member positioned in the cavity of the table, proximal to the light source, may be used to help guide the illumination towards the table top and message portion.

The coffee table system further comprises a plurality of tiles that can be arranged in the message portion to display a message. The tiles are defined by multiple faces displaying alphanumeric characters, or symbols, or both. The tiles may be manipulated in various ways in a logical order on the message portion to display a message that is easily viewable in the depressed message portion of the table top. The illumination from the light source also enhances viewing of the alphanumeric characters and symbols that make up the message. In one possible embodiment, the formulated message allows multiple users to communicate easily and without requiring computing or electrical power.

The coffee table system further comprises an at least partially transparent ornamental member that is disposed on the table top. The ornamental members can be rearranged on the table top to achieve various decorative looks. The illumination from the light source illuminates the ornamental member while on the table top to enhance the decorative effect thereof. The partially transparent ornamental member creates a decorative effect that can serve as a conversation piece, along with the table.

One objective of the present invention is to provide a coffee table on which messages and ornamental members can be displayed in a clearly visible, ornamental manner.

Another objective is to provide a coffee table that is also a conversation piece and a center of attention in a room.

Yet another objective is to enable messaging between parties directly on a coffee table without requiring a processor or electrical power.

Yet another objective is to illuminate the alphanumeric characters and symbols, and the ornamental member for enhanced viewing of messages and decorative effects.

Yet another objective is to illuminate the tiles displaying the message for enhanced viewing.

Yet another objective is to provide alphanumeric characters or symbols on all of the faces of the tiles, so that if some tiles are lost, a message may still be arranged.

Yet another objective is to guide the illumination from the light source towards the table top; and specifically the message portion and the ornamental member.

Yet another objective is to enable manipulation of both the tiles and the ornamental member on the table top, so as to achieve changeable messaging and reconfigurable decorative configurations.

Yet another objective is to buffer the table from the ground surface with a resilient base, such as a foam panel or foam rim that supports the sidewalls in an upright position.

Yet another objective is to provide an inexpensive to manufacture messaging and ornamental coffee table system.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
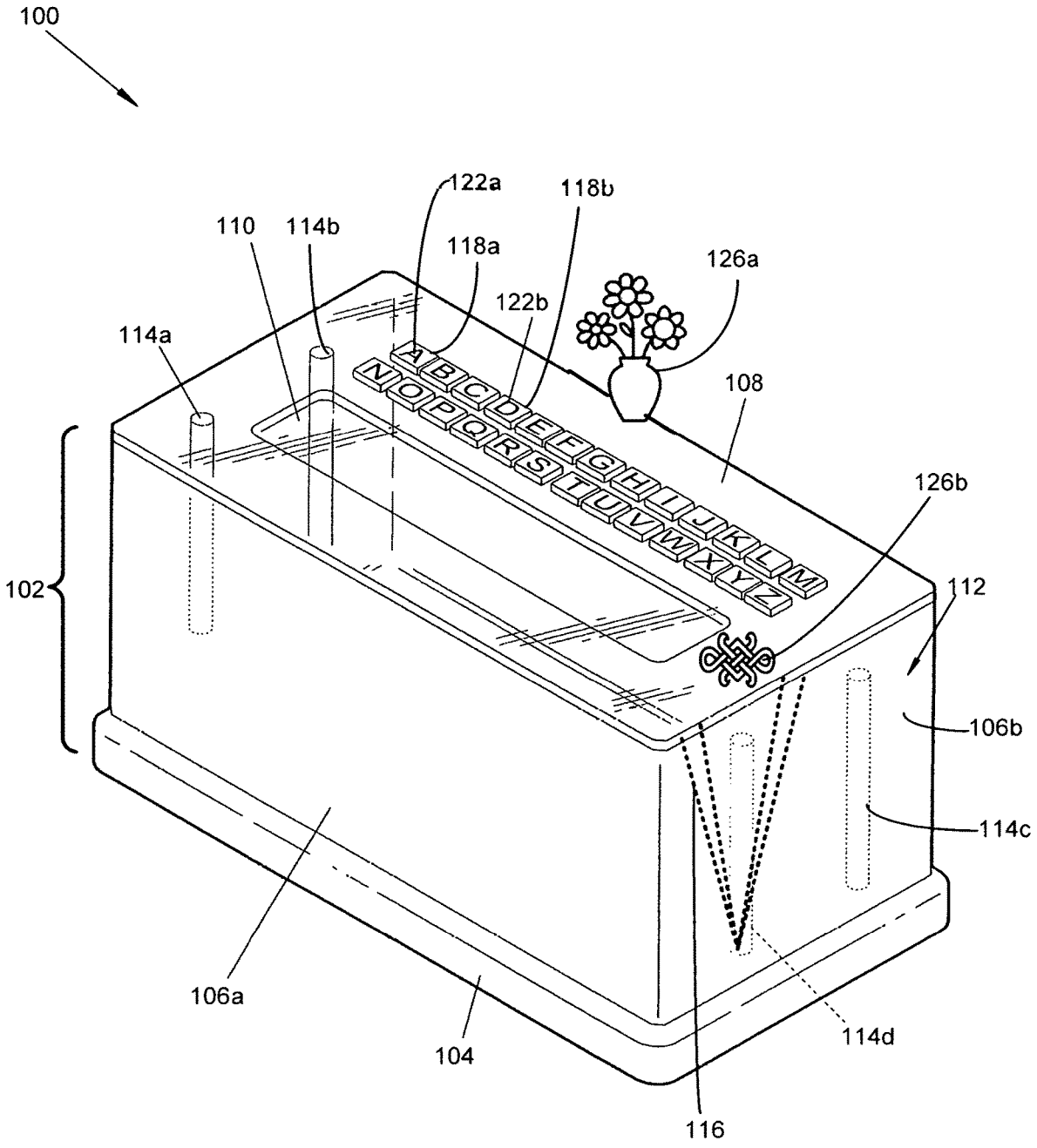
FIG. 1 illustrates a perspective view of an exemplary messaging and ornamental coffee table system, in accordance with an embodiment of the present invention.
Figure 2:
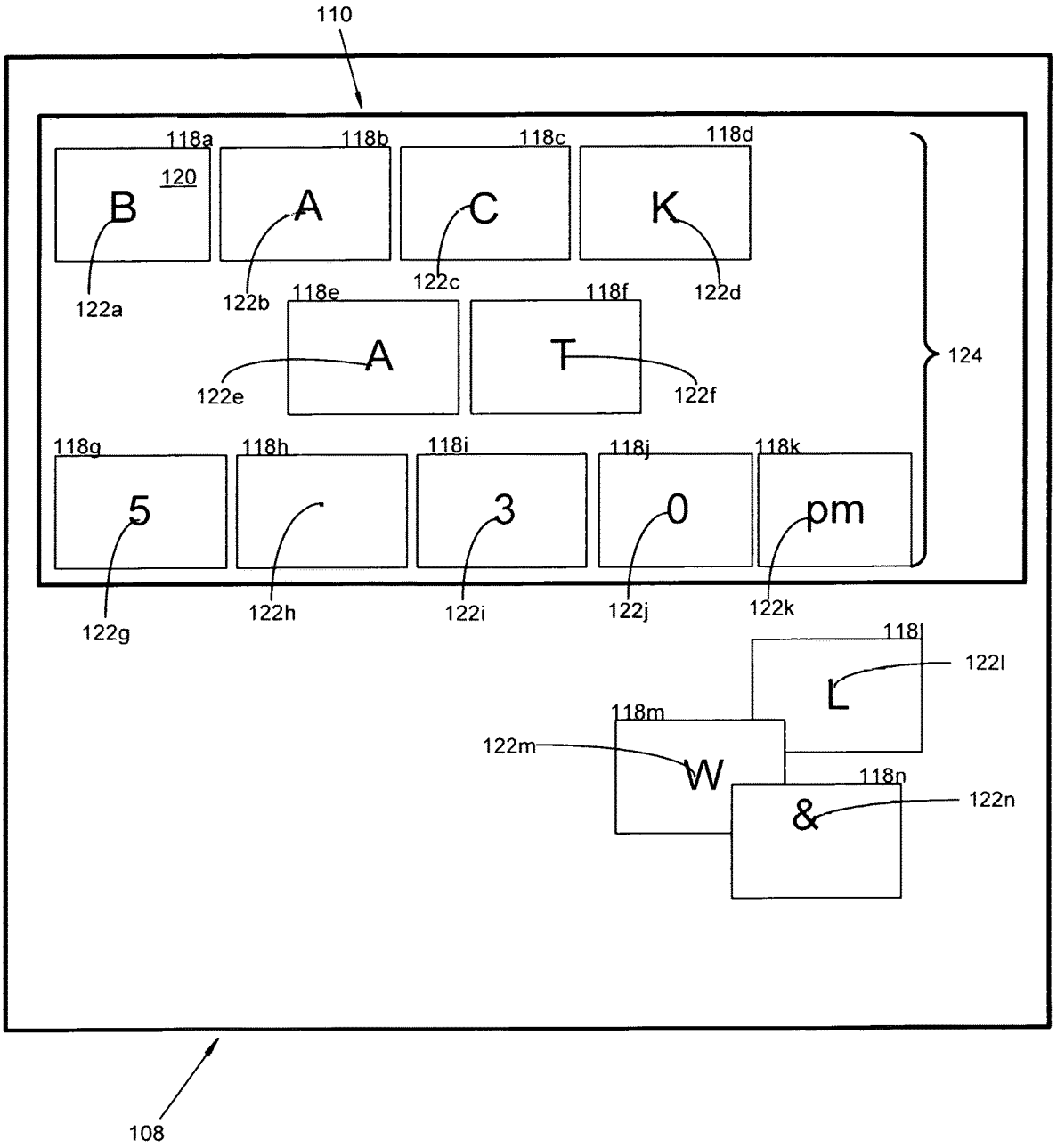
FIG. 2 illustrates a perspective view of exemplary tiles displaying an alphanumerical message on an exemplary message portion of a table top, in accordance with an embodiment of the present invention.
Figure 3:
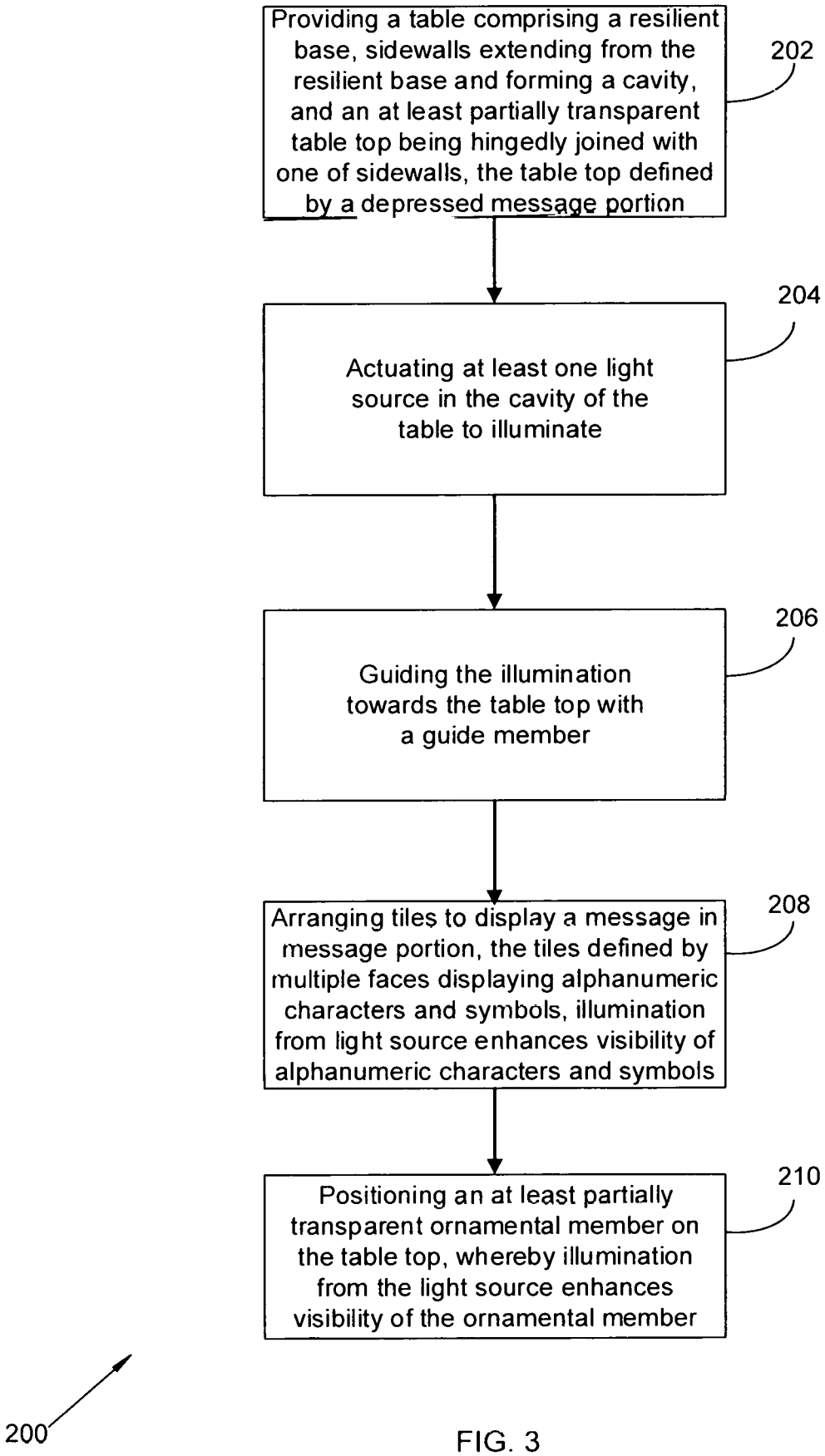
FIG. 3 illustrates a flowchart diagram of an exemplary method of operating a messaging and ornamental coffee table system, in accordance with an embodiment of the present invention.

A messaging and ornamental coffee table system 100 and method 200 of operation is referenced in FIGS. 1-3. The messaging and ornamental coffee table system 100, hereafter "system 100" provides a supportive table 102 that is used to carry a message 124 and an at least partially transparent ornamental member 126*a*, 126*b* in a clearly visible and decorative manner. In this way, both the table 102 and the contents thereon, i.e., tiles 118*a-n*, ornamental members 126*a-b*, can serve as a conversation piece.

In some embodiments, the table 102 may include a low table used in living rooms to display items or serve refreshments, such as a coffee table. However in other embodiments, the table 102 may include, without limitation, a dining room table, used for seated persons to eat meals; a bedside table, which is used to place an alarm clock and a lamp; and specialized tables such as drafting tables, cooking tables, and sewing tables. In one non-limiting embodiment, the table 102 may be dimensioned at 8"×12"×4". Though in other embodiments, the table 102 may be larger or smaller.

In one non-limiting embodiment referenced in FIG. 1, the table 102 comprises a resilient base 104 resting on a ground surface; a plurality of sidewalls 106*a*, 106*b* extending up from the resilient base 104 and forming a cavity 112; and an at least partially transparent table top 108 resting on the sidewalls 106*a-b*, and movable between an open position and a closed position thereon.

The resilient base 104 may include a foam platform or foam frame that provides support and prevents scratching of the ground surface on which the table 102 rests. In one non-limiting embodiment of the resilient base 104, plexiglass forms a perimeter boundary around the foam panel. The sidewalls 106*a*, 106*b* of the table 102 may include four rigid panels forming a generally rectangular shape. Suitable 102 materials for the sidewalls 106*a-b* may include, without limitation, wood, metal, rigid polymers, glass, and plexiglass.

The at least partially transparent table top 108 provides the supportive, generally flat surface on which the arrangable message 124 and ornamental member 126*a*, 126*b* position for viewing. The table top 108 is hingedly connected to one of the sidewalls 106*a*, 106*b*, so as to regulate access to the cavity 112. However in other embodiments, the table top 108 slidably joins the sidewalls 106*a*, 106*b* and regulates access to the cavity 112 by sliding between open and closed positions. In one embodiment, the table top 108 is a translucent panel that is fabricated from a substantially flat, rigid material, such as glass, plexiglass, or the like.

As illustrated in FIG. 2, the table top 108 may be defined by a depressed message portion 110. The message portion 110 may include a rectangular shape and be depressed into the table top 108 at least 1". Though other dimensions, shapes, and numbers of message portions may be used in other embodiments. The message portion 110 is configured to be clearly visible, and potentially illuminated from the table top 108.

Turning again to FIG. 1, the system 100 further comprises at least one light source 114*a-d* that is operational to illuminate from the cavity 112 of the table 102. The light source 114*a-d* is configured to direct the illumination towards and through the at least partially transparent table top 108. In this manner, objects on the table top 108 are visually enhanced by the illumination. This also creates a unique lighting effect for the table 102 that increases ornamental aspects and interest therein.

In some embodiments, the light source 114*a-d* may include a fluorescent LED strip, a fluorescent light, an incandescent light bulb, a neon light, or a candle that is oriented to illuminate towards the table top 108. In other embodiments, the light source 114*a-d* illuminates at variable colors, intensities, and lighting patterns, so as to achieve a desired visual and ornamental effect. The intensity, color, and lighting pattern of such light source 114*a-ds* can be adjusted to achieve a desired decorative effect on the table top 108 and message portion 110 thereof. In some embodiments, a power source, such as a battery, an exterior outlet, or a solar panel may be used to power the light source 114*a-d*.

To further guide the illumination towards the table top 108, and specifically the message portion 110, a guide member 116 is utilized inside the cavity 112 to help guide the illumination towards the table top 108 and message portion 110. The guide portion 116 may be disposed in the cavity 112 of the table 102 and may include, without limitation, a funnel or two parallel panels extending at least partially from the light source 114*a-d* towards the table top 108.

The coffee table 102 system 100 further comprises a plurality of tiles 118*a-n*, which enable the messaging functionality of the system 100. In one non-limiting embodiment, the tiles 118*a-n* include ½" blocks. In one non-limiting embodiment, the tiles 118*a-n* may include blocks having six faces 120, with each face having a unique alphanumeric character or symbol. The tiles 118*a-n* can be rotated to display a desired message in the message portion 110 of the table top 108. Though other configurations of the tiles 118*a-n* are possible.

The tiles 118*a-n* are configured to be easily arranged in a logical order, so as to relay a message 124 between parties. The tiles 118*a-n* may be arranged within the depressed message portion 110 of the table top 108 for enhanced visibility. In some embodiments, the tiles 118*a-n* are defined by multiple faces 120 displaying alphanumeric characters, or symbols 122*a-n*, or both. The alphanumeric characters may include, without limitation, letters for a language, or numbers, such as "A", "B", "ش", "ε", and "4". The symbols may include, without limitation, an arithmetic symbol or a punctuation, such as "Δ", "-", and ";".

The tiles 118*a-n* are arrangable in a logical order on the message portion 110 to display a message 124 that is easily viewable in the depressed message portion 110 of the table top 108. In one non-limiting embodiment, formation of the message 124 involves selecting and rotating tiles 118*a-n* until a desired character or symbol is found, and then placing the selected tile in the selected alphanumeric character or symbol 122*a-n* in a face-up orientation into the depressed message portion 110.

In other yet embodiments for creating the message 124, the tiles 118*a-n* may be configured as raised members in a keyboard configuration, which allows individual tiles having the desired alphanumeric character or symbol to be depressed, so as to create the desired message 124. In yet other embodiments, the tiles 118*a-n* are fitted into slots that from in the message portion 110 to achieve a logical order of alphanumeric characters and symbols 122*a-n*, so as to relay the message 124. In one possible embodiment, the formulated message arranged with the tiles 118*a-n* allows multiple users to communicate easily and without requiring computing or electrical power.

For example, as shown in FIG. 2, the tiles 118*a-n* are arranged to relay the message 124 "Back at 5:30 pm". This indicates that a first user, who arranged this message, is not available; but will be available at 5:30 pm. In response to this message 124, a second user may rearrange the tiles 118*a-n* to dictate, "See you at the park tonight". This second message would direct the first user to go to the park after 5:30 pm, since the second user will be there. The tiles 118*a-n* are unique in that they allow eclectic messages to be relayed between multiple users in this manner.

Furthermore, the illumination from the light source 114*a-d* illuminates towards the message portion 110; and thereby the alphanumeric characters and symbols 122*a-n* on the tiles 118*a-n* to enhance the visibility thereof. This is unique illuminating capacity of the system 100 is possible because the table top 108 is at least partially transparent, and illumination is guided directly in that direction by the guide member 116.

In alternative embodiments of the system 100, the alphanumeric characters and symbols 122*a-n* displayed on the faces 120 of the tiles 118*a-n* may be manipulated to play a word game, such as Scrabble™ directly on the table top 108. In yet other embodiments, the alphanumeric characters and symbols 122*a-n* may be used for teaching languages or math. In yet other embodiments, the alphanumeric characters and symbols 122*a-n* may be used to provide a variation of overall display, adding interest and decorative effects for a homeowner or decorator.

In one alternative embodiment, a plurality of tiles are digitally depicted on the message portion as alphanumeric characters or symbols. In this alternative embodiment, the message portion may include a digital screen, known in the art (not shown). The digitally depicted alphanumeric characters and symbols may then be arranged digitally through manipulation of buttons or a keyboard (not shown) that is operatively connected to the message portion, so as to form the message from the logical arrangement of alphanumeric characters and symbols. This alternative embodiment may include a processor to translate the keyed in characters and symbols to digital representations thereof on the digital screen. Nonetheless, the act of arranging and rearranging the alphanumeric characters and symbols to develop a message is substantially the same as with the multi-faceted tiles 118*a-n* discussed above.

Looking again at FIG. 1, the system 100 further comprises an at least partially transparent ornamental member 126*a*, 126*b* that is disposed on the table top 108. One or more ornamental members 126*a-b* may be placed on the table top 108. The ornamental members 126*a-b* can be rearranged on the table top 108 to achieve various decorative looks. The ornamental member 126*a-b* may include, an object commonly placed upon, or associated with coffee table. The ornamental member 126*a-b* may also include, without limitation, a figurine, an ashtray, a vase, a glass, a plate, a tray, a book, and a decorative object sized and dimensioned to fit on the table top 108. In any case, the ornamental member 126*a-b* enhances the conversational possibilities of the table 102, and the system 100 as a whole.

The illumination from the light source 114*a-d* illuminates the ornamental member 126*a-b* while positioned on the table top 108. This illuminating effect allows the ornamental object 126*a-b* to glow and reflect light; and thereby enhances the decorative effect thereof. In essence, the glowing and reflective properties of the at least partially transparent ornamental member 126*a-b* creates a decorative effect that can serve as a conversation piece on the table 102.

FIG. 3 illustrates a flowchart diagram of an exemplary method 200 of operating a messaging and ornamental coffee table system. The method 200 may include an initial Step 202 of providing a table, the table comprising a resilient base, a plurality of sidewalls extending from the resilient base and forming a cavity, and an at least partially transparent table top being hingedly joined with one of the sidewalls, the table top defined by a depressed message portion. A Step 204 comprises actuating at least one light source in the cavity of the table to illuminate.

In some embodiments, a Step 206 may include guiding the illumination towards the table top with a guide member. A Step 208 comprises arranging a plurality of tiles to display a message in the message portion of the table top, the tiles defined by multiple faces displaying alphanumeric characters, or symbols, or both, whereby the illumination from the light source enhances visibility of the alphanumeric characters, or symbols, or both. A final Step 210 includes positioning an at least partially transparent ornamental member on the table top, whereby the illumination from the light source enhances visibility of the at least partially transparent ornamental member.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A messaging and ornamental coffee table system comprising:

a coffee table comprising a foam base, four sidewalls extending from the foam base and forming a cavity, and an at least partially transparent table top hinged to one of the four sidewalls, wherein the table top comprises a depressed message portion;

a plurality of tiles each comprising a six-faced block wherein each face of said tiles displays a letter, symbol, or both, wherein the plurality of tiles are arranged to display a message in the depressed message portion of the table top, an at least partially transparent ornamental member disposed on the table top, at least one light source in the cavity of said coffee table; and a guide member disposed proximal to the at least one light source, the guide member directing light from the light source towards the partially transparent table top to illuminate the partially transparent ornamental member and the tiles in the depressed message portion.

2. The messaging and ornamental coffee table system of claim 1, wherein the depressed message portion comprises a generally rectangular shape.

3. The messaging and ornamental coffee table system of claim 1, wherein the depressed message portion comprises a depth of at least one inch.

4. The messaging and ornamental coffee table system of claim 1, wherein the at least one light source includes at least one of the following: a light emitting diode strip, a fluorescent bulb, an incandescent light bulb, a neon light, and a candle.

5. The messaging and ornamental coffee table system of claim 1, wherein the light source illuminates at variable colors, intensities, and lighting patterns.

6. The messaging and ornamental coffee table system of claim 1, wherein the guide member comprises a funnel or a pair of parallel panels.

7. The messaging and ornamental coffee table system of claim 1, wherein the at least partially transparent ornamental member includes at least one of the following: a figurine, an ashtray, a vase, a glass, a plate, a tray, and a book.

* * * * *